US007128812B1

(12) United States Patent
Cupit

(10) Patent No.: US 7,128,812 B1
(45) Date of Patent: Oct. 31, 2006

(54) APPARATUS AND METHOD FOR DETERMINING THE LEVEL IN A COKE DRUM

(76) Inventor: Carl E. Cupit, 6373 Jefferson, Groves, TX (US) 77619

( * ) Notice: Subject to any disclaimer, the term of this patent is extended or adjusted under 35 U.S.C. 154(b) by 709 days.

(21) Appl. No.: 10/045,946

(22) Filed: Jan. 15, 2002

Related U.S. Application Data

(60) Provisional application No. 60/276,856, filed on Mar. 19, 2001.

(51) Int. Cl.
*C10B 47/00* (2006.01)

(52) U.S. Cl. ..... 201/1; 201/9; 201/10; 700/45; 700/266; 208/DIG. 1; 208/131; 250/301; 250/302; 250/303; 250/900

(58) Field of Classification Search ..... 700/45, 700/266; 201/1, 9, 10; 208/DIG. 1, 131; 406/10, 12, 34; 356/27, 51; 250/301, 302, 250/303, 900
See application file for complete search history.

(56) References Cited

U.S. PATENT DOCUMENTS 3,501,632 A * 3/1970 Wright et al. ..... 378/52
4,176,052 A 11/1979 Bruce et al.
4,344,819 A * 8/1982 Gerdes, Jr. ..... 201/1
4,698,303 A 10/1987 Bailey et al.
4,727,247 A * 2/1988 Johnston ..... 250/361 R
4,755,677 A * 7/1988 Blincow et al. ..... 250/357.1
4,884,457 A * 12/1989 Hatton ..... 73/861.04
5,028,311 A * 7/1991 Shigley et al. ..... 208/131
5,099,124 A * 3/1992 Benson ..... 250/357.1
5,127,772 A * 7/1992 Dewitz ..... 406/93
5,132,917 A * 7/1992 Bass ..... 702/45
5,667,669 A * 9/1997 Hart ..... 208/131

* cited by examiner

*Primary Examiner*—Glenn Caldarola
*Assistant Examiner*—Alexis Wachtel
(74) *Attorney, Agent, or Firm*—Richard L. Moseley

(57) ABSTRACT

A foam level in a delayed coking drum is detected by utilizing the varying density of the boiling mass in the coke drum which has larger bubbles and is less dense at the top and smaller bubbles and a higher density at the bottom. A plurality of radiation detectors are disposed on the drum and calibrated such that zero radiation is equivalent to 100 percent level. The percentage reading for each detector is multiplied by the fraction of height each detector is in relation to the total height of all the detectors to give a product and the products summed to give a level.

12 Claims, 3 Drawing Sheets

APPARATUS AND METHOD FOR DETERMINING THE LEVEL IN A COKE DRUM

This application is a continuation of patent application Ser. No. 60/276,856 filed on Mar. 19, 2001.

BACKGROUND OF THE INVENTION

1. Field of the Invention

The present invention relates to delayed coking processes and coke drums in particular. More particularly the invention related to a system for accurately determining the froth or foam level in a coke drum on a delayed coking unit.

2. Related Information

Delayed coking processes are used in petroleum refineries to convert residuum, vacuum tower bottoms or other asphaltic process streams—normally referred to as charge on a delayed coker—into more valuable refinery products such as gasoline, diesel and gas oils. Process equipment normally associated with a delayed coker are a main fractionating tower, furnaces, coke drums, fractionation equipment, pumps, a compressor, various heat exchangers, etc. One of the products produced on a delayed coker is petroleum coke which is formed in the coke drums.

In the delayed coking processes, the residuum or other asphaltic material is circulated through a furnace for heating to coking temperature and then delivered to the coke drum where a coke product as well as the more useful products form from the thermal cracking of the heated heavy hydrocarbons. The overhead of the coke drum is quenched and circulated to a combination or fractionating tower for separation of the overhead into gas, gas oil, fuel oil, naphtha and the like. When the coke drum is filled with coke, a mechanical process of removing the coke from the coke drum is begun. Generally during the process of removing the coke from the coke drum, the circulation of the heated heavy hydrocarbon is switched to a second coke drum which fills with coke as the first coke drum is being mechanically emptied. The time between switching coke drums is the coking cycle. Most delayed coking units are operated to maximize charge rate. The variable that generally controls or dictates the charge rate is the level in the coke drum. In the vernacular of the industry that level is referred to as the foam level.

Once the foam level has reached what is considered an optimum level the charge from the furnace is switched to a second drum. The filled drum is then steam stripped for removal of residual light hydrocarbons and then cooled with water. In the process of stripping, cooling, etc., the material in the coke drum solidifies into petroleum coke which is removed mechanically.

The coke drum is designed to contain the coke and any other phenomena associated with the formation of petroleum coke. An inherent part of that process is the formation of foam in the coke drum. Downstream equipment used to recover the higher valued products from the coking process are not designed to handle the foam hence the need to assure its containment within the coke drum.

Many theories abound as to the phenomena of what is taking place in an operating delayed coker coke drum. The common theory is that the coke forms from the bottom of the drum up as the heated charge passes from the furnace into the coke drum. This theory says that "rat holes" form in the coke which allows the subsequent material to pass up through the drum.

The inventor herein has noted that the material left in the coke drum which has not been properly cooled oozes out of a coke drum after the head is removed which contradicts the theory that solid coke has formed. Also large amounts of steam, which is a vapor at the process conditions (temperature and pressure) utilized in the coking process, are injected with the charge residuum at the furnaces. If the hot residuum formed solid coke with "rat holes" as soon as it entered the drum as previously describe, an inordinate amount of back pressure for the incoming charge would develop. Further, by design 45+% of the residuum vaporizes in the coking furnaces. Ultimately as much as 70% by weight of the charge is thermally cracked to hydrocarbon vapors in the coke drum which has to flow up through the material in the coke drum into downstream recovery equipment. This vapor flow would be impeded and aggravate the back-pressure problem if solid coke was forming from the bottom of the coke drum upward as the drum is fed.

SUMMARY OF THE INVENTION

The invention is based upon the hereto before undiscovered phenomenon that the material in the coke drum is a boiling, highly viscous and fluid mixture of hydrocarbon material in which thermal cracking is taking place. The thermal cracking, the vaporization that has occurred in the furnaces, and the steam injected at the furnaces result in the evolution of large bubbles of hydrocarbon gases and steam. The bubbles at the bottom of the drum are smaller and grow into larger bubbles as they flow upward through the boiling, cracking mass of hydrocarbon material being fed into the drum and combine with other cracked hydrocarbon vapors and steam. The entire mass of material in the drum is being continuously fed and is boiling much as viscous material boils on a kitchen stove. The boiling mass of material in the coke drum has a hydrocarbon vapor and steam-foam or a hydrocarbon vapor-bubble interface where the large bubbles are bursting. This interface moves up the drum as the drum is filled from the bottom. The material left in the drum after the bubbles burst is the material that forms the petroleum coke when cooled. If this material is carried out the top of the coke drum into downstream equipment serious fouling and upsets occur. Hence, after this hydrocarbon vapor-foam interface moves up the drum, it is extremely important to accurately monitor that interface to assure the foam does not go out the top of the drum with the hydrocarbon vapors.

The hydrocarbon vapors in a coke drum have a lower density immediately after switching to a new drum. After running into the drum for several hours the hydrocarbon vapors tend to get more dense for a few hours. The hydrocarbon vapors get even more dense near the foam front and the foam is very noticeably denser than the hydrocarbon vapors. Since the material in the coke drum is a boiling mass with larger bubbles at the top and smaller bubbles at the bottom, at steady state conditions the material in the drum has a density change that is fairly linear being less dense at the top and more dense at the bottom. At non-steady state conditions, though, the density at any given point in the drum changes.

The density of the foam or boiling hydrocarbon in the coke drum at any given elevation in the drum from the top of the hydrocarbon-foam interface down to the bottom of the drum and at any given time changes as a function of several factors. Some of these factors include the type of feed being fed to the coke drum, the velocity of the hydrocarbon vapor flow through the boiling mass as a result of the feed rate to the coke drum being changed (something not abnormal on a delayed coking unit), injection of an anti foam material into the coke drum which helps to collapse the bubbles at the hydrocarbon vapor and the steam-foam interface by reducing the surface tension of the bubbles, sudden changes of pressure inside the coke drum from switching the coke drums and other normal functions on a delayed coking unit, changes in temperature inside the coke drum, etc. This phenomenon had not been previously recognized by the industry, but it can be demonstrated by and likened to boiling viscous material in a pot on a kitchen stove.

The discovery and use of the heretofore unknown phenomenon enabled the inventor to determine the appropriate length, configuration and mounting of nuclear detectors and use, calibrate and display the output of those detectors in a distributive control system (D.C.S.) or computer to precisely track and monitor this phenomenon and which is the invention.

The system may most briefly be said to comprise:

(a) a plurality of linear radiation detectors mounted length wise along the height of the coke drum;

(b) a radiation source or sources mounted on the coke drum opposite said radiation detectors;

(c) each of said radiation detectors initially calibrated to read one hundred percent level when no radiation is detected.

The method of detecting the level comprises:

(a) placing a plurality of radiation detectors along the height of said drum;

(b) placing a radiation source on said drum opposite said radiation detectors;

(c) calibrating each of said radiation detectors to read zero percent of level at the radiation count transmitted when only hydrocarbon vapors are present in the drum (d) Initially calibrating each of said radiation detectors to read one hundred percent when no radiation is detected (e) correlating the detected radiation as a percentage of the height of each radiation detector as radiation is blocked by the foam level rising in the coke drum;

(f) transmitting the radiation count of each radiation detector to a distributive control system or computer for display;

(g) multiplying the percentage reading for each detector by the fraction of height each detector is in relation to the total height of all the detectors to give a product; and (h) summing all of the resulting products to give a foam level.

DETAILED DESCRIPTION OF THE PREFERRED EMBODIMENT

Figure 1:
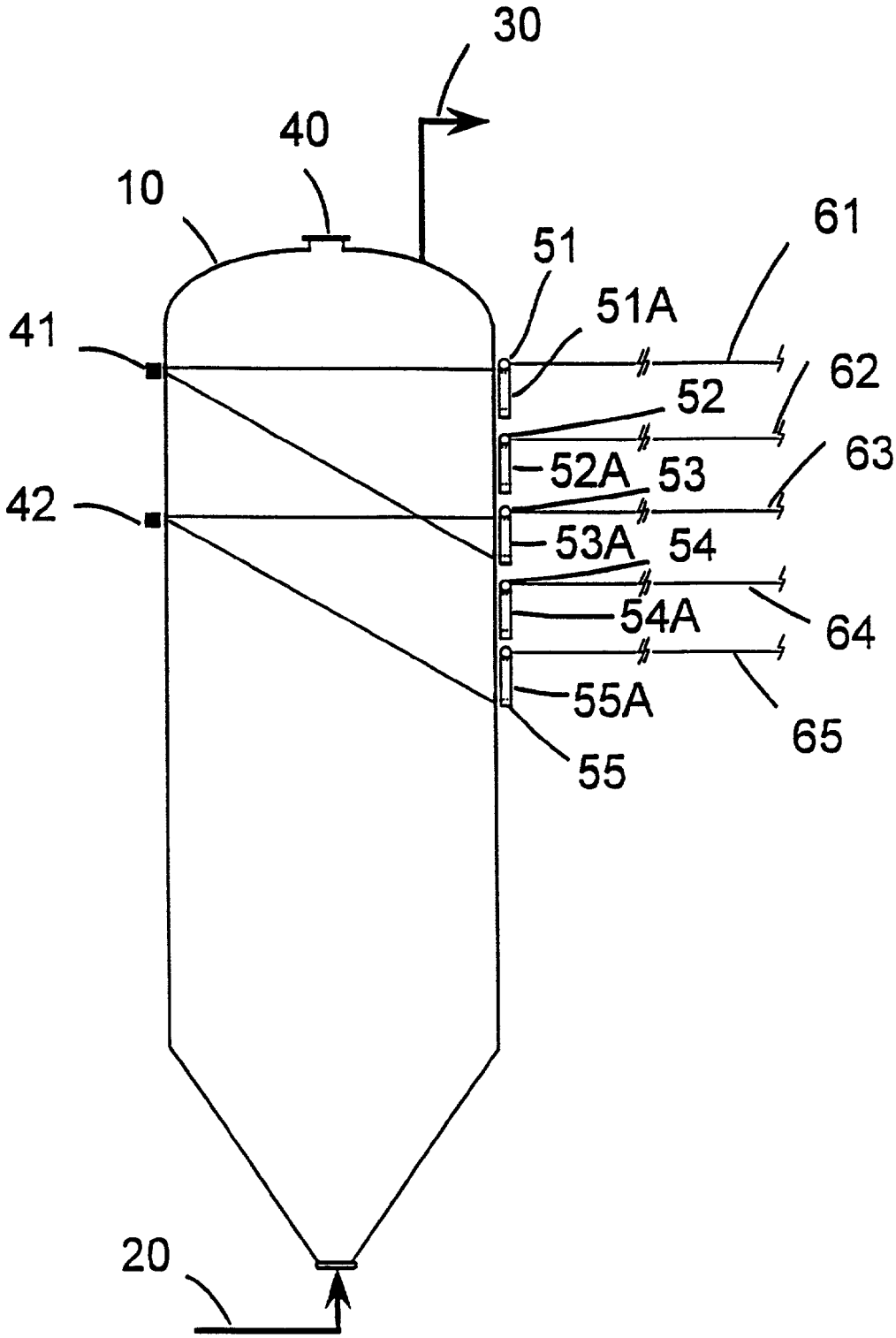
FIG. 1 is a schematic in plan view of a coke drum showing the location of the radiation source and detector tubes.

Because of economic considerations it is important to safely utilize as much of the drum capacity as possible. In addition, the industry practice is to inject a material into a coke drum in an effort to minimize the height of the foam as previously described. The anti foam agent is typically a silicon based compound or chemical. The silicon is deleterious to downstream processing units and therefore its usage is generally limited to minimize that impact. Typically anti foam agents are injected when the foam front nears the top of the coke drum although some refiners inject the anti foam agent on a continuous basis. The level system of the present invention allows optimizing the amount of anti foam agent used to control the foam level in the drum.

Due to the importance of not allowing foam to flow out the top of the coke drum it is extremely important to accurately and continuously monitor the foam level as it approaches the top of the drum to assure that does not happen. Accurately and continuously monitoring the foam level has heretofore not been possible because the phenomenon of the boiling hydrocarbons which is happening in the coke drum was not understood. The present invention, however, provides a system which continuously monitors with extreme accuracy the foam level in the coke drum to within +/−one foot. Accuracy is only limited by changing dynamics at the hydrocarbon vapor-foam interface due to the numbers and size of the large bursting bubbles.

Based upon the "rat hole" theory the prior art drum level detection systems typically use back scatter radioactive devices which are normally referred to as point detectors, meaning each detector provides an indication at a precise point on a coke drum. The system works on the basis of the concentration of hydrogen ions or molecules in the material in the coke drum. Usually a point detector level system consists of four point detectors mounted at different elevations on the coke drum. Each detector has a radioactive source that emits radiation. The particular radiation emitted is absorbed in proportion to the concentration of hydrogen ions or molecules present. Each detector is capable of monitoring an area of the coke drum that is approximately a thirty six inch diameter circle. The measure of the amount of radiation absorbed is used to indicate more or less dense hydrogen rich material at that area of the coke drum. Since the material in the coke drum is hydrocarbon based material hydrogen ions or molecules are present and the concentration of the hydrogen ions or molecules are indicative of the density of the hydrocarbons. Since coke drums range from sixty to one hundred twenty plus feet in height and eighteen to thirty plus feet in diameter, four detectors such as these point detectors cannot monitor a long vertical distance of the drum to provide continuous measurement of the hydrocarbon vapor-foam interface. Consequently the drum cannot safely be utilized to the maximum.

The other prior art level system in use over the years consists of one long (16 to 20+ feet) detector (an ion chambers or other long linear detection device) mounted on the side of the coke drum which measures the amount of radiation emitted from a radioactive source which is mounted on the opposite side of the drum.

The output of a linear detector is the average radiation count over the entire length of the detector. Consequently the output of the detector can indicate the same radiation with a less dense material between the radioactive source and the entire length of the detector as with a more dense material between the source and the lower one fourth of the detector. Hence with a changing density in the coke drum one detector cannot provide an accurate indication of the foam level by the time the foam has reached the top of the detector tube.

The industry has not applied or used the heretofore undiscovered phenomenon noted by the inventor to develop a level system that is accurate. The assumption has been that the density of the foam in the coke drum is a constant and that the long detector accurately reflects the foam level once calibrated when it fact it does not. Industry has never configured the various components of a radioactive system to provide an accurate and continuous portrayal of the hydrocarbon vapor-foam interface phenomenon. Too, the prior art systems cannot be calibrated to provide a continuous indication of the hydrocarbon-foam interface that is accurate for the reasons indicated above.

Because of the size of the foam bubbles in a coke drum and varying density of the foam in a coke drum the invention requires a level system having multiple radioactivity detectors such as ionization tubes, scintillation detectors or other types of linear detectors of varying but relatively short lengths mounted vertically along the side of the coke drum to achieve the resolution necessary to provide accuracy of measurement. A long detector configured with switches or other devices to make it perform as several short detector tubes can also be used.

Each detector can be from one to two feet in length up to six feet or so in length depending on the total length of the level system and the diameter of the coke drum. The resolution needed to achieve the desired accuracy determines the length of each individual detector and requires that the level system is always to be comprised of multiple relatively short detectors mounted vertically along the side of the drum. The number of detector tubes used is determined by the vertical distance of the coke drum to be monitored. The detector tubes may be mounted end to end or be separated by some nominal distance determined by the drum diameter. Individual detectors mounted end to end but separated by a nominal distance provides greater accuracy for larger diameter drums. The strength and number of radioactive sources to be used with each level system is determined by the manufacturer of the radioactive source and the detectors. Suitable radioactive sources are Model No. SH-F2-01K-A30-M3-SOO-PO Radioactive Source Holder with a 1000 Mci Cesium 132 Source manufactured by OhmartVega Corporation of Cincinnati, Ohio. Suitable scintillation detectors include Model LSTH-060-HO-MO-SOO-PO also manufactured by OhmartVega Corporation of Cincinnati, Ohio.

The detectors are initially calibrated such that when the coke drum has hydrocarbon vapors in it, e.g., after the drum has been charged for three or four hours, the radiation count at that time will represent a zero foam level at the detectors. Whether it is done at that time or at some other time, the window on the radioactive source holder is closed such that no radiation is detected by the detector. Each individual detector is then calibrated such that this reading represent 100% for each detector. If there are five equal length detector tubes comprising the entire detector level system each tube at 100% will represent one fifth or 20% of the entire foam level.

After the drum is charged the level detectors are recalibrated to provide the extreme accuracy required to monitor the foam level. Foam rises in the coke drum as the drum is charged and passes the lowest detector which causes the radiation count transmitted from the detector to begin to fall. When the foam passes the top of a lower detector the radiation of the next highest detector will begin to fall. The lower detector will then be recalibrated to indicate 100 percent level at the radiation count it was reading at the time the radiation count on the next higher detector begins to fall. The remaining detectors are recalibrated accordingly. The radiation count used to reset the 100 percent level of all the lower detectors is linear and the radiation count determined from that linearity is used to recalibrate the top detector to indicate a 100 percent level of that detector.

Referring now to FIG. 1 a schematic of the coke drum 10 with the radiation sources 41 and 42 in place is shown. The coke drum 10 is shown to have an inlet 20 at the bottom where the heated residuum or hydrocarbon is fed. Vapors formed as a result of the thermal cracking are removed via an overhead line 30. Flanged header 40 provides access after the coking cycle is complete. Opposite the radiation sources are the detectors 51–55 each having active lengths 51A-55A within the tubes but generally not extending the entire length of the tube. The signals representing the radiation count from the detectors are carried to the control house and computer via electrical signal lines 61–65.

Figure 3:
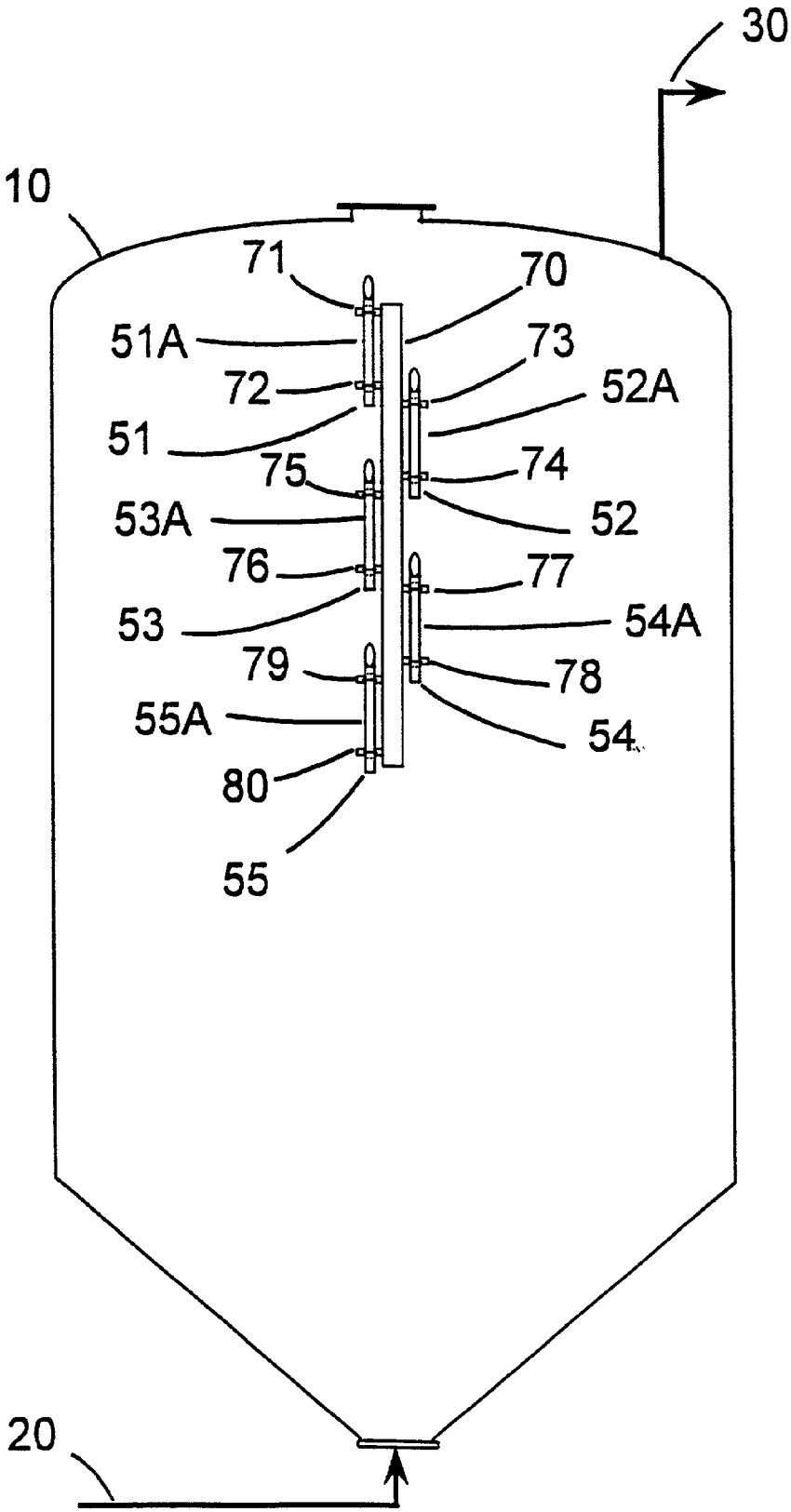
FIG. 3 is a schematic in plan view showing more detail of the mounting of the detector tubes on the coke drum.

Referring now to FIG. 3 more detail of the mounting of the detector tubes 51–55 is shown. A central mounting bracket 70 is secured to the outside of the coke drum 10. Detector tube 51 with sensing element 51A is mounted to the central bracket 70 by mounting brackets 71 and 72. Detector tube 52 with sensing element 52A is mounted to the central bracket 70 by mounting brackets 73 and 74. Detector tube 53 with sensing element 53A is mounted to the central bracket 70 by mounting brackets 75 and 76. Detector tube 54 with sensing element 54A is mounted to the central bracket 70 by mounting brackets 77 and 78. Lastly detector tube 55 with sensing element 55A is mounted to the central bracket 70 by mounting brackets 79 and 80. The detector tubes 51–55 are mounted substantially end to end, however these can be mounted such that there is some space separating the sensing elements 51A–55A.

Figure 2:
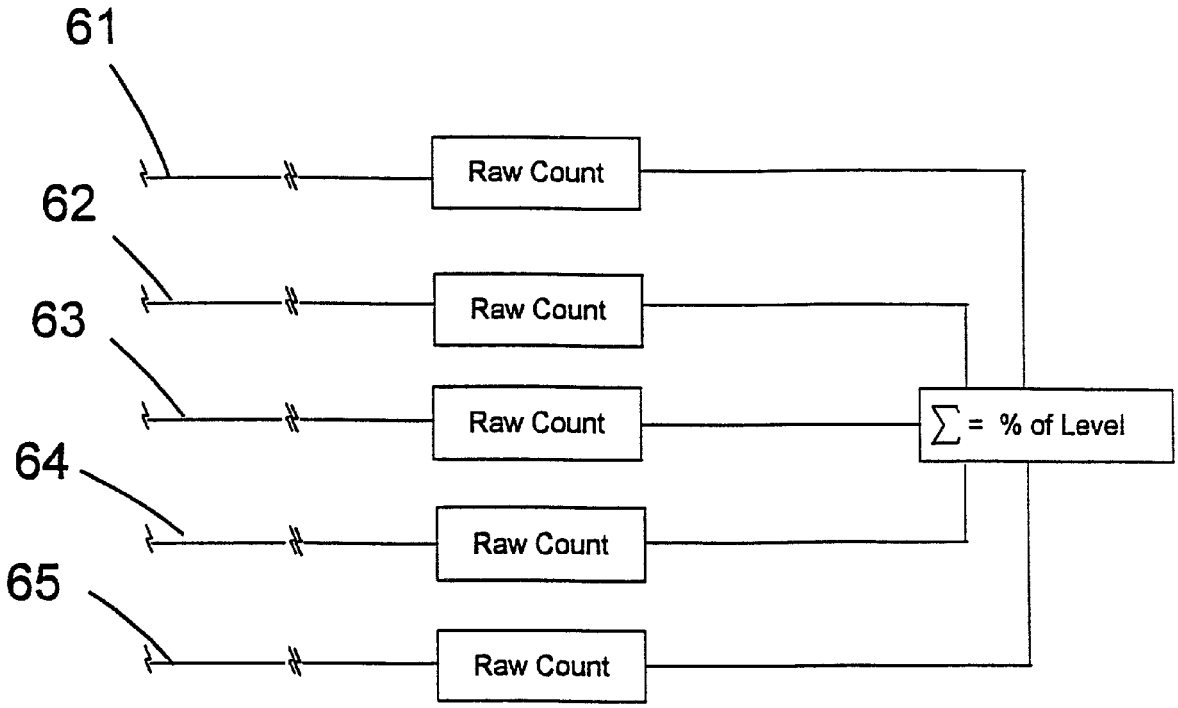
FIG. 2 is a schematic of the method of calculation of the foam level.

When foam rises in the coke drum and begins to block or absorb the radiation such that the detector tube is sensing less than the zero setting, the indicated output of the detector for the tube will begin to show a foam level. As the foam level continues rising, the detector tube transmits less and less radiation and the indicated level of the foam rises toward 100% of that detector which accounts for a percentage of the total level. FIG. 2 indicates the calculation as the signals come into the calculator via electrical signal transmitters 16–65. The raw count is then multiplied by the percentage of the whole that each tube is accountable and then summed to get the total level.

Although each tube has been calibrated to show 100% level when it detects no radiation, the foam at this time may not be dense enough to completely block the radiation and the detector may still be transmitting a radiation count. With the foam level completely covering a detector but yet the detector still transmitting a radiation count, the radiation count of the detector above may begin to fall indicating the foam has actually reached the next level. This resolution is part of the reason for the placement of a plurality of detectors along the length of the drum with some nominal distance between the active sensing area of each detector. The nominal distance may be a few inches to a foot depending upon the desired accuracy.

The number of detector tubes will depend upon the height of the drum and the desired level of accuracy and the vertical height of the drum that is to be monitored.

The invention claimed is:

1. A level system for detecting a foam level in a delayed coking drum comprising:

(a) a plurality of linear radiation detectors mounted length wise along the height of the coke drum;

(b) a radiation source mounted on the coke drum opposite and directly across said coke drum from said radiation detectors;

(c) each of said radiation detectors being calibrated to read one hundred percent level when no radiation is detected.

2. The level system according to claim 1 wherein each of said radiation detectors is spaced apart a nominal distance along the height of said drum.

3. The level system according to claim 1 wherein each of said radiation detectors is placed end to end along the height of said drum.

4. A method of detecting a foam level in a delayed coking drum comprising:

(a) placing a plurality of linear radiation detectors along the height of said drum;

(b) placing a radiation source on said drum opposite said radiation detectors;

(c) calibrating each of said radiation detectors to read zero percent level at the radiation count of the detector when only hydrocarbon vapors are present in the drum adjacent to the detectors;

(d) calibrating the output each of said radiation detectors to read one hundred percent when no radiation is detected;

(e) detecting radiation as a percentage of the height of each radiation detector as radiation is blocked by the foam level rising in the coke drum;

(f) multiplying the percentage reading for each detector by the fraction of height each detector is in relation to the total height of all the detectors to give a product; and (g) summing all of the resulting products to give a foam level;

(h) wherein the output of each detector is recalibrated after the feed is started to read 100 percent when the radiation count of the next higher detector begins to fall.

5. The method according to claim 4 wherein the output of all except the topmost of the radiation detectors are recalibrated after feed is started to read 100 percent when the radiation count of the next higher detector begins to fall and output of the topmost detector output is recalibrated based upon a linear interpolation of the lower recalibrations.

6. The method according to claim 4 wherein the radiation count of each detector is indicated in a distributive control system.

7. The method according to claim 4 wherein the radiation count of each detector is indicated in a computer.

8. The system according to claim 2 wherein each radiation detector is calibrated at zero when the coke drum is filled with hydrocarbon vapors.

9. The system according to claim 8 wherein each successive radiation detector from the bottom is recalibrated to 100% when it begins to detect a level using the radiation count of the next lower radiation detector at that time.

10. The system according to claim 3 wherein each radiation detector is calibrated at zero when the coke drum is filled with hydrocarbon vapors.

11. The system according to claim 10 wherein each successive radiation detector from the bottom is recalibrated to 100% when it begins to detect a level using the radiation count of the next lower radiation detector at that time.

12. A method for calibrating a plurality of linear radiation detectors which are mounted substantially end to end along the height of a coke drum to measure the level of foam contained in the drum, comprising;

(a) initially calibrating all of said radiation detectors to read zero percent level at the radiation count of the detector when only hydrocarbon vapors are present in the drum adjacent to the detectors;

(b) initially calibrating the output each of said radiation detectors to read one hundred percent when no radiation is detected;

(c) recalibrating the output of each successively higher detector except the topmost after feed is started to read 100 percent at the raw radiation count when the radiation count of the next higher detector begins to fall; and (d) recalibrating the topmost detector to read 100 percent based upon linear interpolation of the lower recalibrations.

* * * * *